US008523491B2

(12) United States Patent
Brinkmann et al.

(10) Patent No.: US 8,523,491 B2
(45) Date of Patent: Sep. 3, 2013

(54) MOBILE, YEAR-ROUND ARCTIC DRILLING SYSTEM

(75) Inventors: Carl Rhys Brinkmann, Bellaire, TX (US); George F. Davenport, Cypress, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 348 days.

(21) Appl. No.: 12/280,315

(22) PCT Filed: Feb. 13, 2007

(86) PCT No.: PCT/US2007/003903

§ 371 (c)(1),
(2), (4) Date: Aug. 21, 2008

(87) PCT Pub. No.: WO2007/126477

PCT Pub. Date: Nov. 8, 2007

(65) Prior Publication Data

US 2010/0221069 A1 Sep. 2, 2010

Related U.S. Application Data

(60) Provisional application No. 60/787,602, filed on Mar. 30, 2006.

(51) Int. Cl.

| | |
|---|---|
| ***E02D 5/74*** | (2006.01) |
| ***E02D 5/54*** | (2006.01) |
| ***E02B 17/02*** | (2006.01) |

(52) U.S. Cl.

USPC ..... 405/203; 405/217; 405/224; 114/265

(58) Field of Classification Search

USPC ..... 405/195.1–197, 203–205, 224, 224.1, 405/226, 217; 114/264, 265

See application file for complete search history.

(56) References Cited

U.S. PATENT DOCUMENTS

| | | | | |
|---|---|---|---|---|
| 3,575,005 | A * | 4/1971 | Sumner | 405/196 |
| 3,793,840 | A | 2/1974 | Mott et al. | |
| 3,965,840 | A | 6/1976 | Blumberg | |

(Continued)

FOREIGN PATENT DOCUMENTS

| | | |
|---|---|---|
| RU | 2 040 638 C1 | 7/1995 |
| RU | 2 174 930 C2 | 5/2001 |

(Continued)

OTHER PUBLICATIONS

European Search Report No. 113910, Jun. 22, 2006, 3 pages.

(Continued)

*Primary Examiner* — Tara M. Pinnock

(74) *Attorney, Agent, or Firm* — ExxonMobil Upstream Research Company-Law Department

(57) ABSTRACT

A mobile, year-round drilling system (MYADS) for drilling offshore wells and/or performing other offshore activities at multiple, successive locations in an arctic or sub-arctic environment is provided. The present invention combines the ability to move to different locations and the strength to resist ice loading when on location and when ice-covering is present in the arctic or sub-arctic environment. The MYADS applies a multiple leg "jack-up" concept in which supporting legs are lowered through a hull to touch down on the seabed and elevate the hull out of the water.

52 Claims, 5 Drawing Sheets

(56) References Cited

U.S. PATENT DOCUMENTS

| | | | | |
|---|---|---|---|---|
| 4,011,826 | A | 3/1977 | Yee | |
| 4,089,287 | A | 5/1978 | Kranert et al. | |
| 4,249,619 | A | 2/1981 | Burns | |
| 4,451,174 | A | 5/1984 | Wetmore | |
| 4,648,751 | A | 3/1987 | Coleman | |
| 4,735,167 | A | 4/1988 | White et al. | |
| 4,747,359 | A | 5/1988 | Ueno | |
| 4,899,832 | A | 2/1990 | Bierscheid, Jr. | |
| 5,036,781 | A | 8/1991 | Jarvi | |
| 5,109,934 | A | 5/1992 | Mochizuki | |
| 5,188,484 | A | 2/1993 | White | |
| 5,218,917 | A | 6/1993 | Harjula et al. | |
| 5,228,806 | A | 7/1993 | De Medieros, Jr. et al. | |
| 5,248,005 | A | 9/1993 | Mochizuki | |
| 5,288,174 | A * | 2/1994 | Kjersem et al. | 405/196 |
| 5,290,128 | A | 3/1994 | Yeargain et al. | |
| 5,292,207 | A | 3/1994 | Scott | |
| 5,941,746 | A | 8/1999 | Isnard et al. | |
| 6,003,598 | A | 12/1999 | Andreychuk | |
| 6,113,314 | A | 9/2000 | Campbell | |
| 6,162,105 | A | 12/2000 | Breivik | |
| 6,336,419 | B1 | 1/2002 | Breivik | |
| 6,374,764 | B1 | 4/2002 | Davenport, III et al. | |
| 6,499,914 | B1 | 12/2002 | Patout et al. | |
| 6,622,793 | B1 | 9/2003 | Rylov et al. | |
| 6,745,852 | B2 | 6/2004 | Kadaster et al. | |
| 6,799,528 | B1 | 10/2004 | Bekker | |
| 6,848,382 | B1 | 2/2005 | Bekker | |
| 6,886,487 | B2 | 5/2005 | Fischer, III | |
| 7,258,510 | B2 * | 8/2007 | Kawasaki | 405/198 |
| 7,377,225 | B2 | 5/2008 | Finn et al. | |
| 2002/0100589 | A1 | 8/2002 | Childers et al. | |
| 2003/0057769 | A1 | 3/2003 | Scott | |
| 2004/0060717 | A1 | 4/2004 | Leppanen | |
| 2004/0060739 | A1 | 4/2004 | Kadaster et al. | |
| 2004/0115006 | A1 | 6/2004 | Facey et al. | |
| 2006/0096513 | A1 | 5/2006 | Kulikov et al. | |

FOREIGN PATENT DOCUMENTS

| | | | |
|---|---|---|---|
| WO | WO 96/40549 | A1 | 12/1996 |
| WO | WO 2006/058400 | A1 | 6/2006 |
| WO | WO 2007/089152 | A1 | 8/2007 |
| WO | WO 2008/115068 | A1 | 9/2008 |

OTHER PUBLICATIONS

Marine Structure Consultants (MSC) bv, "Mobile Production Concepts", Product Sheet 00-004, (2006), 4 pages.

PCT International Search Report and Written Opinion, Mar. 20, 2008, 9 pages.

English translation of Russian Patent SU 1311625 A3, Jun. 14, 1983, 4 pages.

English translation of Russian Patent SU 1608288 A1, Mar. 22, 1988, 5 pages.

English translation of Russian Patent SU 1708160 A3, Mar. 23, 1984, 6 pages.

English translation of Russian Patent SU 1758157 A1, Dec. 29, 1990, 4 pages.

* cited by examiner

MOBILE, YEAR-ROUND ARCTIC DRILLING SYSTEM

REFERENCE TO PRIORITY APPLICATION

This application is the National Stage entry under 35 U.S.C. 371 of PCT/US2007/003903 that published as WO 2007/126477 and was filed on Feb. 13, 2007 and claims the benefit of U.S. Provisional Application 60/787,602, filed 30 Mar. 2006.

BACKGROUND OF THE INVENTION

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

The present invention relates to a mobile, year-round arctic drilling system, also referred to herein by the acronym "MYADS." It is a drilling system for drilling offshore wells and/or performing other offshore activities at multiple, successive locations in a "sub-Arctic" environment. The system combines the ability to move to different locations and the strength to resist ice loading when on location and when ice-covering is present in the sub-Arctic environment.

The "sub-arctic" offshore environment is characterized by yearly, seasonal incursions of ice. This environment is less severe than that of the "high" arctic environment that may have ice present year-round. However, even the sub-arctic environment presents problems for the use of standard offshore drilling systems. The standard offshore drilling systems are primarily designed to resist loading from waves, winds and currents, and, where necessary, earthquakes, but not from ice. In a sub-arctic environment, the overall or global loading due to ice impingement on an offshore drilling system could be an order of magnitude higher than that associated with wave, wind and current loading. Thus, the structure of a typical offshore drilling structure would not able to withstand the significantly higher forces in a sub-arctic environment.

Ice impingement can also create large pressure forces in small, local areas of any drilling equipment structure. For a typical offshore drilling system, these high local forces would damage unprotected frame brace elements since these elements are typical offshore structures designed solely to resist wind, waves and current.

The advantage of mobility is that it allows the drilling equipment to operate at widely different locations without the need to build a permanent structure to support the drilling equipment at each location.

Some current drilling structures have been designed for sub-arctic conditions. However, most of these structures are configured as permanent (non-mobile), production/drilling/quarters (PDQ) platforms. Various kinds of icecrush resistant drilling structures are also known. Brick-type systems, such as the Concrete Island Drilling System (CIDS) described in U.S. Pat. No. 4,011,826, are one type of an ice crush resistant structure. Another example is the structure disclosed in U.S. Pat. No. 5,292,207. Each of these systems is a large, permanent, walled structure configured to receive drilling rigs.

Other existing systems require some major structural components to be permanently on location (i.e., only the drilling facilities themselves are mobile). One example is the Deck Installation System for Offshore Structures disclosed in U.S. Pat. No. 6,374,764. Another example is the monopod jack-up configuration disclosed in U.S. Pat. No. 4,451,174. In these systems, a different sub-structure anchored to the seabed is required for each new drill location.

Another example of a monopod jack-up system is the offshore platform erection system and method of U.S. Pat. No. 4,648,751, which utilizes a single leg attached to a permanently installed substructure. The single-leg structure is jacked up by a retractable jacking system. Once at operating height, the deck is secured to the single leg, and the drilling derrick is moved into position to drill. The monopod jack-up is intended to drill exploration wells in an arctic environment. However, this configuration is only designed for exploration drilling with no provision for re-deployment over an active well site. Further, the single-column design may not be structurally sound for seismically-active locations.

Existing mobile drilling systems for non-arctic conditions, such as the conventional jack-up system, cannot operate in areas where the structure may come into contact with ice floes. There are two types of such conventional jack-ups: (1) those supported on open lattice structural legs and (2) those supported on closed cylindrical legs. Neither of these existing designs is capable of resisting local and global loading due to sub-arctic ice.

The open-lattice leg design is not suitable to resist the local ice forces as individual members of the lattice structure would be bent or crushed by the local ice forces. The closed-cylindrical leg design improves on this drawback. However, current designs are not suitable to resist the high local ice loads as the legs are primarily designed to resist much smaller wave loading. Some current closed-cylindrical leg designs have moments of inertia as low as 1.1 meters to the fourth power ($m^4$).

Neither of the above designs is capable of resisting the global ice loads typical of sub-arctic regions. These global ice loads can easily be an order of magnitude higher than the wave and wind loads to which conventional jack-ups are designed to resist.

Accordingly, a need exists to configure a structure that can support offshore drilling operations while able to withstand both global and local ice loading that will occur during the yearly, seasonal incursions of ice. In addition, the structure should have the capability to relocate to a new drilling site during the relatively ice-free time of the year, and return, if necessary. Preferably, the relocation time may be relatively short and require no significant offshore logistics support (i.e., nothing more than a few towing vessels).

Other related material may be found in at least U.S. Pat. No. 4,249,619; U.S. Pat. No. 5,228,806; U.S. Pat. No. 5,288,174; and U.S. Pat. No. 5,290,128.

SUMMARY OF THE INVENTION

According to one embodiment of the present invention, a mobile drilling system is provided. The mobile drilling system comprises a hull; at least two legs adapted to be lowered through the hull to contact a seabed and elevate the hull out of the water; at least one foundation associated with at least one of the at least two legs; and a drilling rig located on the hull. Each of the at least two legs has a closed structure comprising an outer plate and an inner plate forming an annulus, wherein a bonding agent is disposed in the annulus.

According to other aspects of the invention, each leg may be of cylindrical shape with an outer plate diameter of about 10 meters of greater, or about 15 meters or greater or about 20 meters or greater. The thickness of the outer plate may be about 25 millimeters (mm) to about 50 mm. Further, the leg may be of cylindrical shape with an inner plate diameter of about 14 meters. The thickness of the inner plate may be about 25 mm to about 50 mm, but preferably less than the outer plate thickness. The bonding agent may comprise at least one of grout or elastomeric agent. The foundation may have a diameter of about 25 meters to about 35 meters. One or more of the foundation structures may be capable of securing wellheads when the system is removed from its location. Additionally, the moment of inertia of the mobile drilling system may be between about 100 $m^4$ and about 130 $m^4$. Further, the mobile drilling system may be utilized in a sub-arctic environment.

According to another embodiment of the present invention, a method of offshore drilling is provided. The method of offshore drilling comprising providing a mobile drilling system, wherein the mobile drilling system comprises a hull; at least two legs adapted to be lowered through the hull to contact a seabed and elevate the hull out of a body of water; at least one foundation associated with at least one of the at least two legs; and a drilling rig located on the hull, wherein each of the at least two legs having a closed structure comprising an outer plate and an inner plate forming an annulus, wherein a bonding agent is disposed in the annulus. The method further comprises drilling through at least one of the at least two legs.

According to yet another embodiment of the present invention, a method of producing hydrocarbons is provided. The method of producing hydrocarbons comprising providing a mobile drilling system comprising a hull; at least two legs adapted to be lowered through the hull to contact a seabed and elevate the hull out of a body of water; at least one foundation associated with at least one of the at least two legs; and a drilling rig located on the hull, wherein each of the at least two legs having a closed structure comprising an outer plate and an inner plate forming an annulus, wherein a bonding agent is disposed in the annulus. The method further includes drilling through a leg of the drilling system. The drilling may include drilling through an ice-resistant caisson.

According to still another embodiment of the present invention, a method of installing an offshore drilling system is provided. The method of installing an offshore drilling system comprising transporting a mobile drilling system to a location in a body of water. The mobile drilling system comprises a hull; at least two legs; at least one foundation associated with at least one of the at least two legs; and a drilling rig located on the hull, wherein each of the at least two legs having a closed structure comprising an outer plate and an inner plate forming an annulus, wherein a bonding agent is disposed in the annulus. The method further includes lowering the at least two legs to a seabed; elevating the hull above a surface of the body of water; penetrating the at least one foundation into the seabed; and positioning the drilling rig over a drilling location.

According to a fifth embodiment of the present invention, a method of removing an offshore drilling system is provided. The method of removal comprising providing a mobile drilling system in a first location in a body of water, wherein the mobile drilling system is installed at the first location. The mobile drilling system comprises a hull; at least two legs; at least one foundation associated with at least one of the at least two legs; and a drilling rig located on the hull, wherein each of the at least two legs having a closed structure comprising an outer plate and an inner plate forming an annulus, wherein a bonding agent is disposed in the annulus. The method further includes securing at least one of the at least one foundation to protect a wellhead located in the at least one of the at least one foundation; lowering the hull into the body of water; raising the at least two legs; and transporting the mobile drilling system to a second location.

According to a sixth embodiment of the present invention a method of re-installing an offshore drilling system is provided. The method of re-installing an offshore drilling system comprising providing a mobile drilling system on a body of water. The mobile drilling system comprises a hull; at least two legs; at least one foundation associated with at least one of the at least two legs; and a drilling rig located on the hull, wherein each of the at least two legs having a closed structure comprising an outer plate and an inner plate forming an annulus, wherein a bonding agent is disposed in the annulus. The method further includes transporting the mobile drilling system to a drilling location, wherein the drilling location includes a first foundation; lowering the at least two legs to a seabed, wherein one of the at least two legs is lowered into the first foundation; elevating the hull above a surface of the body of water; penetrating the foundation of the remaining legs of the at least two legs into a seabed; and positioning the drilling rig over a drilling location. Additionally, the foundation may provide well protection to subsea wellheads and one of the legs may be lowered into the first foundation utilizing a guide system.

BRIEF DESCRIPTION OF THE FIGURES

The foregoing and other advantages of the present invention may become apparent upon reviewing the following detailed description and drawings of non-limiting examples of embodiments in which.

DETAILED DESCRIPTION

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

It may be economically advantageous to develop offshore oil and gas reservoirs by locating well centers at de-centralized locations. Having several drilling centers may allow better reservoir recovery, for example. Also, if one section of a reservoir is discovered to have lower than expected recovery, a smaller, de-centralized well center can be decommissioned more easily. A decentralized well center may be particularly advantageous in sub-arctic regions where it may be desirable to move equipment due to ice impingement or other environmental conditions.

The primary disadvantage to prior designs of drilling systems is the increased cost associated with building a permanent drilling structure at every location identified for drilling.

Rather than construct several permanent structures for each drilling location, a single mobile drilling structure can drill all locations using the same structure at a significantly reduced manufacturing cost. Therefore, the present invention addresses the problem of configuring a mobile structure that can support facilities for drilling offshore wells and/or performing other offshore activities at multiple, successive locations in a sub-arctic environment.

The present structure, referred to as the "mobile, year-round artic drilling system" (MYADS), combines the mobility to move to different drilling locations and the strength to resist ice loading when on location. Some embodiments of the MYADS may comprise a floating hull having supporting legs which are lowered through the hull to touch down on the seabed and may elevate the hull out of the water for performing offshore activities.

Figure 1:
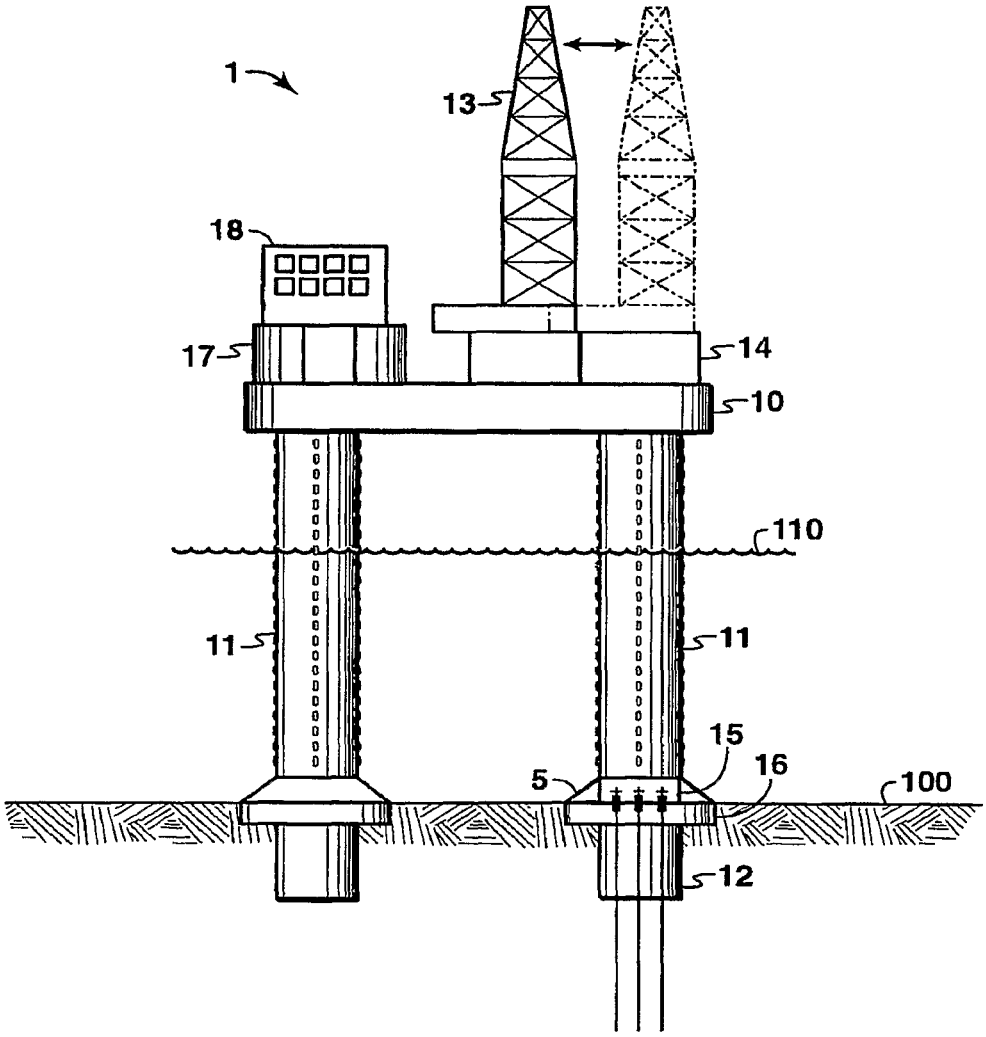
FIG. 1 is an exemplary illustration of a side view of a MYADS in accordance with the present invention.

Turning now to the drawings, FIG. 1 is an exemplary illustration of a side view of a MYADS in accordance with the present invention. The MYADS 1, having a hull 10, at least two legs 11 adapted to be lowered through the hull 10 to contact a seabed 100 and elevate the hull out of the water 110, a foundation system 12, which may be a suction caisson foundation, and a drilling rig 13 supported on skid beams 14 for positioning the drilling rig 13 over at least one subsea wellhead silo system 15. In some embodiments of the present invention, the MYADS may have three legs or four legs, or five legs, or more, the legs 11 being adapted to be lowered through the hull 10 to contact a seabed 100 and elevate the hull 10 out of the water 110. The hull 10 provides buoyancy to the structure when the legs 11 are elevated. Short distances may be traveled by towing the hull 10, while long distances may be traveled on a transport vessel (not shown). As also shown in FIG. 1, in some embodiments of the present invention the MYADS 1 may comprise an ice-protective cone 5 and scour skirt 16 on each of the legs 11, as well as protective jackhouse 17 for supporting the elevating and clamping systems. The MYADS 1 may also comprise living quarters, a helideck 18, and any other facilities know to those of skill in the art that may be found on an offshore drilling platform.

Referring now to the legs 11 of the MYADS 1, a person of skill in the art understands that the shape of the legs may be significant, but that numerous cross-sectional shapes are applicable to the present invention. Preferably, the legs 11 are cylindrically shaped, in which cases the legs 11 have a circular cross-sectional shape. The legs 11 may have any cross-sectional shape, provided such cross-sectional shape permits the legs 11 to withstand the anticipated ice loads. For example, in alternative embodiments, the legs 11 may be of oval, elliptical, hexagonal, pentagonal, square, triangular cross-sectional shape, or a combination of shapes. In each case, the MYADS' legs 11 will be of the closed type (as opposed to the lattice type). In some embodiments, the closed legs 11 have a moment of inertia of about 20 $m^4$ or greater, or about 50 $m^4$ or greater, or about 100 $m^4$ or greater, or about 110 $m^4$ or greater, or about 120 $m^4$ or greater, or about 130 $m^4$ or greater. As used herein, "moment of inertia" is the moment of inertia also known as "second moment of area," or "area moment of inertia" and is known to those skilled in the art. Generally, it is a measure of a shape's resistance to bending and deflection and is dependant on the shape of the member being measured.

Some embodiments provide a mobile drilling system comprising: a hull 10; at least two legs 11 adapted to be lowered through the hull 10 to contact a seabed 100 and elevate the hull 10 out of the water 110; a foundation 5 associated with each leg 11; and a drilling rig 13 supported on a skid beam 14, wherein each leg 11 is a closed cylindrical or closed non-cylindrical type having a moment of inertia of about 20 $m^4$ or greater. In some embodiments, each leg 11 is a closed cylindrical type. In some embodiments of the present invention, each leg 11 has a moment of inertia of about 100 $m^4$ or greater.

In yet some other embodiments, a method of producing hydrocarbons comprising: drilling a well in a hydrocarbon reservoir using an embodiment of the MYADS of the present invention and recovering the hydrocarbons from the well is described.

Figure 2:
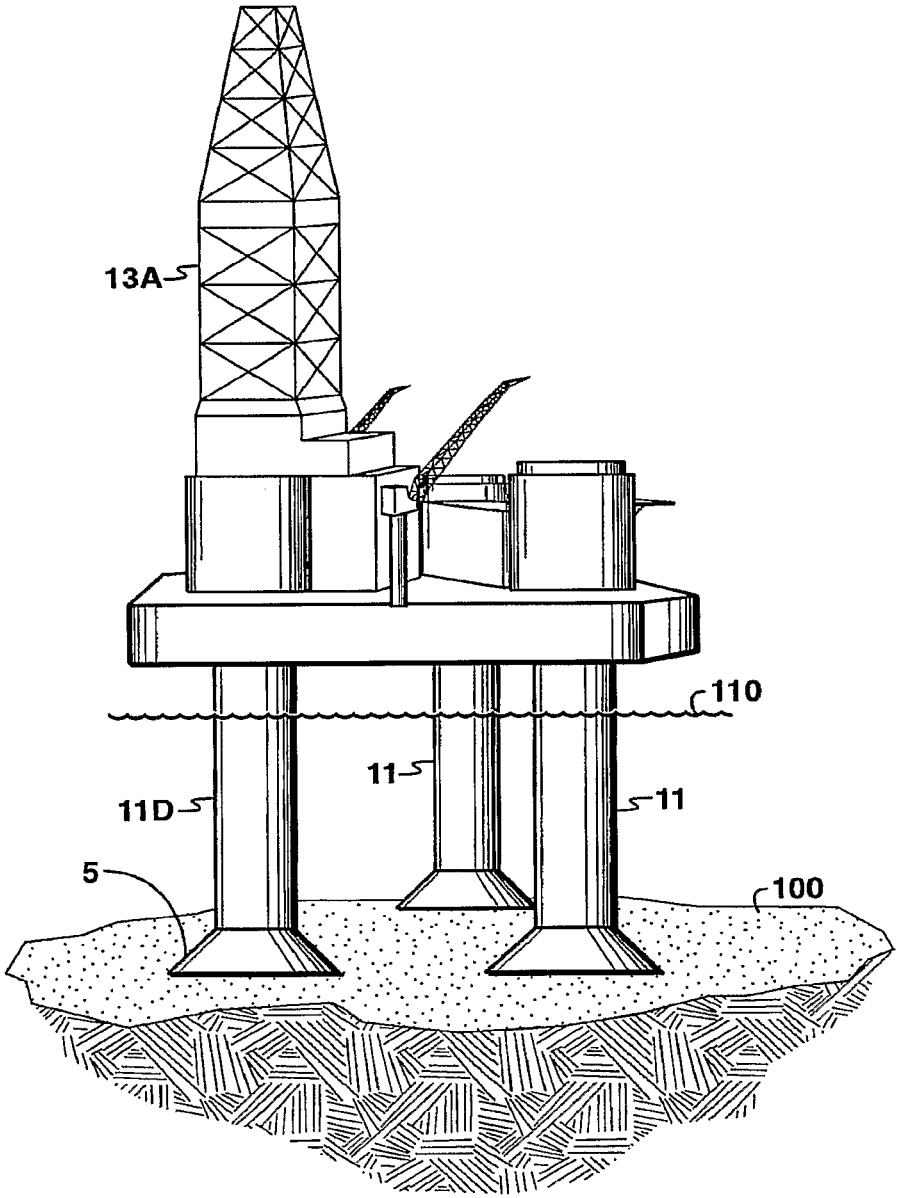
FIG. 2 is an exemplary illustration of an isometric view of an installed MYADS in accordance with the present invention.

FIG. 2 is an exemplary illustration of an isometric view of an installed MYADS in accordance with the present invention. In one or more embodiments, to resist ice forces, the legs 11 of the MYADS are configured as large diameter cylinders. The cylindrical shape minimizes ice loading forces from any particular direction. The large diameter of the legs 11 provides the strength and stiffness required to resist global ice forces. Global ice forces are forces that may cause a structure to fall over or collapse. The legs 11 may be built entirely of steel. To accommodate design requirements for resisting local ice loading or ice forces, in one or more embodiments a composite ("sandwich") construction may be used. Local ice forces are forces that may puncture or damage a structure at a particular location. The composite construction preferably comprises two steel layers separated with a filler material such as a bonding agent. The bonding agent is preferably grout, but other known materials, such as elastomeric agents may be used. FIG. 2 illustrates an embodiment of the invention in which drilling rig 13A is positioned over leg 11D such that the MYADS 1 drilling can be carried out by drilling through leg 11D (also referred to herein as "drilling through a leg.")

A jack-up structure, like the MYADS, resists sub-arctic ice forces using "portalling action," in which the primary resistance to ice loading is mobilized through bending of the legs. Portalling action is the reaction of a portal frame to a load or force and is particularly relevant to the resistance of a bending force. A portal frame is a structure having multiple columns and at least one rafter or equivalent structural member. In the present invention, the portal frame includes the legs of the MYADS and the lintel or platform connected to the legs. A higher moment of inertia is beneficial in resisting ice forces and an increased leg 11 diameter yields a larger moment of inertia. Thus, an increased diameter is preferable to increase the bending load resistance, which resists the ice forces.

To further enhance the portalling action, each leg 11 is preferably supported on a foundation system having a foundation member 12 and skirt member 16, collectively, a foundation system 12, 16. The foundation system 12, 16 provides strength and stiffness to allow the MYADS 1 to resist the loads associated with sub-arctic ice.

To resist local ice forces, the legs 11 of the MYADS 1 are configured as strengthened plates. The strengthening is preferably achieved by combining the outer plate with an inner plate separated with an internal bonding agent. The bonding agent may include an elastomer and the preferred bonding agent is grout. This "sandwich" configuration provides resistance to local ice forces. Alternative strengthening is possible. One such approach may be to apply stiffening members to the inner walls of the legs 11. Some "alternative strengthening" may actually be used concurrently with the strengthening techniques described herein.

In some other embodiments, the MYADS 1 is configured such that drilling is performed through one of the legs of the structure (see FIG. 2). In some embodiments, the MYADS may be configured to drill through an ice-resistant caisson either through a moonpool arrangement or in a cantilever arrangement more typical of conventional jack-ups. The moonpool arrangement locates the drilling rig over an opening in the hull. This arrangement only allows the jack-up to drill over a subsea wellhead system. In the cantilever arrangement, the drill rig is located on a cantilever beam structural system that locates the drill rig outboard of the stern of the jack-up structure. This arrangement allows the jack-up to drill over an existing surface-piercing structure that supports well heads above the surface of the water (e.g. a "dry tree").

Some methods of operation of the present invention include: initial installation, removal of the installation, and re-installation, some exemplary illustrations of which may be seen in FIGS. 3A-D, 4A-D, and 5A-D, respectively. For purposes of illustration, simplified views of the MYADS 1 are shown. It will be understood, however, that, where not explicitly shown, the remainder of the MYADS structure is implicitly present.

Figure 3A:
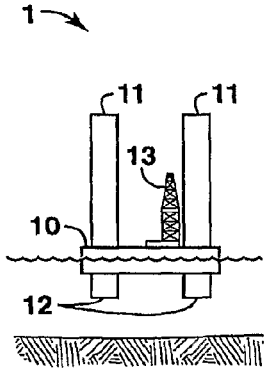
FIGS. 3A-3D are exemplary illustrations of a sequence of an initial installation process of the MYADS of FIGS. 1 and 2 in accordance with the present invention.
Figure 3B:
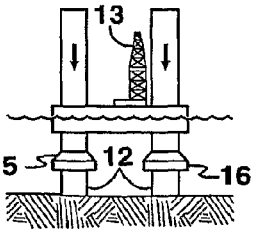
Figure 3C:
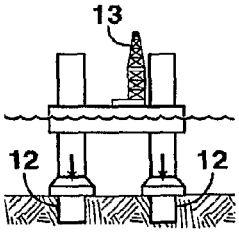
Figure 3D:
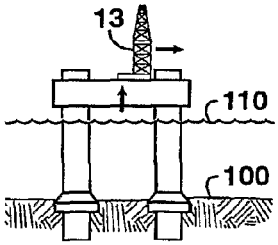

FIGS. 3A-3D are exemplary illustrations of a sequence of an initial installation process of the MYADS of FIGS. 1 and 2 in accordance with the present invention. Accordingly, FIGS. 3A-3D may be best understood by concurrently viewing FIGS. 1 and 2. In FIG. 3A, the MYADS 1 is towed to the location with foundations (not shown) attached to the legs 11 and the drilling structure 13 is in the "transport" position. The ice-protective cone 5 and scour skirts 16 may be located within the hull 10 during transport and are thus not shown. Once on site at the location, the MYADS 1 is moored to stay on location. As shown in FIG. 3B, the MYADS legs 11 are then lowered to the seafloor. The marine motions of the MYADS 1 are reduced due to the extension of the legs 11 below the hull 10, as is well known to those of skill in the art. As shown in FIG. 3C, the foundations 12 are penetrated into the seafloor 100. This penetration is accomplished by applying the weight of the MYADS 1 as the hull 10 is lifted or elevated out of the water 110, as shown in FIG. 3D, by application of additional weight by adding water to "preload" tanks in the hull, and/or by applying suction underneath the foundations 12 and/or by using a jetting system that disturbs the soil sufficiently to ease penetration or other method and apparatus for applying additional weight to the structure to force the foundations 12 to penetrate the sea floor 100. Once on location, the MYADS 1 drilling structure 13 is skidded over the drilling leg 11D, and the well or wells may be drilled.

Figure 4A:
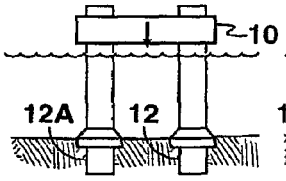
FIGS. 4A-4D are exemplary illustrations of a sequence of a removal process of the MYADS of FIGS. 1 and 2 in accordance with the present invention.
Figure 4B:
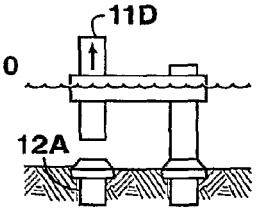
Figure 4C:
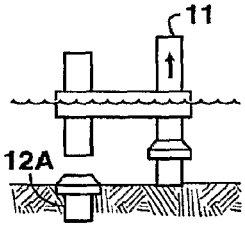
Figure 4D:
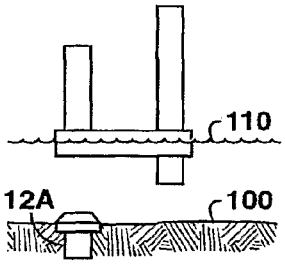

FIGS. 4A-4D are exemplary illustrations of a sequence of a removal process of the MYADS of FIGS. 1 and 2 in accordance with the present invention, which may be accomplished after the initial installation process of FIGS. 3A-3D. Accordingly, FIGS. 4A-4D may be best understood by concurrently viewing FIGS. 1, 2, and 3A-3D. In FIG. 4A, a foundation 12 is first removed from the seafloor 100. This removal is accomplished by applying the upward, buoyant forces as the hull 10 is lowered into the water 110, by applying pressure underneath the foundations 12 and/or by using a jetting system that disturbs the soil sufficiently to ease removal. Referring to FIG. 4B, the foundation system 12A that contains one or more wells may be left in place as protection for the wellheads in the sub-arctic environment. As shown in FIGS. 4C-4D, the MYADS legs 11, 11D are then raised from the seafloor 100, leaving one or more portions 12A of the foundation system 12, 16 to protect one or more wells contained therein. The MYADS 1 is then towed to another drilling location if all foundations 12 remain attached. If a foundation 12A remains on location to protect wellheads, then the MYADS 1 may be towed to a location for installation of a replacement foundation 12A or to a location at which a foundation 12A is already in place.

Figure 5A:
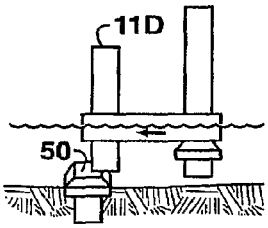
FIGS. 5A-5D are exemplary illustrations of a sequence of a re-installation process of the MYADS of FIGS. 1 and 2 in accordance with the present invention.
Figure 5B:
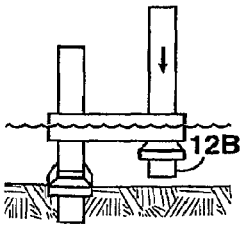
Figure 5C:
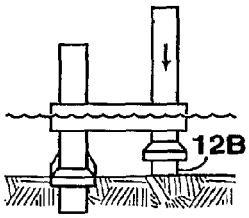
Figure 5D:
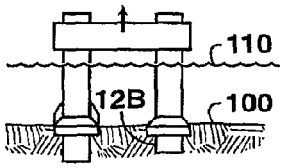

FIGS. 5A-5D are exemplary illustrations of a sequence of a re-installation process of the MYADS of FIGS. 1 and 2 in accordance with the present invention, which may be accomplished after the removal process of FIGS. 4A-4D. Accordingly, FIGS. 5A-5D may be best understood by concurrently viewing FIGS. 1, 2, and 4A-4D. The re-installation operation may be utilized to locate the MYADS on a site where the MYADS has already drilled. Referring to FIG. 5A, the MYADS is towed to a location with one foundation not attached. A guide system 50 locates the drilling leg 11D over the in-place foundation. Once in place, the MYADS legs 11 are lowered to the seafloor 100 and the foundations 12B that have not penetrated the seafloor 100 are then penetrated into the seafloor 100 using one or more of the techniques described above, which is shown in FIGS. 5A-5D. Again, the marine motions of the MYADS 1 are reduced due to the extension of the legs 11 below the hull 10. The remaining foundations 12 are penetrated into the seafloor 100 as described above.

Thus, in one or more embodiments, the MYADS 1 provides a foundation system that: (1) provides access to drilling wells, (2) provides protection to the wells after the MYADS 1 structure leaves, and (3) allows the MYADS 1 to reconnect for future operations at a given site.

The foundation system of the MYADS is enhanced over designs for conventional jack-ups. The foundation system may be structurally enhanced with a variety of structural members, such as central caissons and perimeter skirts. In some preferred embodiments, the foundation diameter is between about 25 meters to about 35 m. In one or more embodiments the central caisson is the same diameter as the legs, which may be from about 10 meters to about 20 meters. One preferred embodiment comprises legs having a diameter of about 15 meters.

Figure 6A:
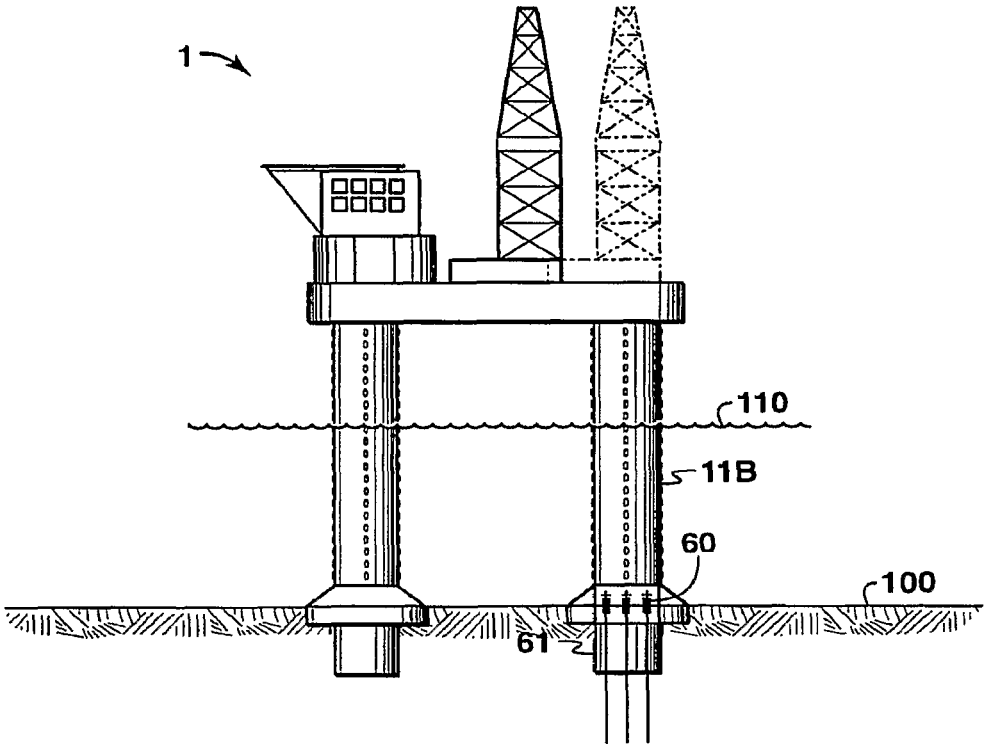
FIG. 6A is an exemplary illustration of drilling with a foundation well protection structure utilizing the MYADS of FIGS. 1 and 2.
Figure 6B:
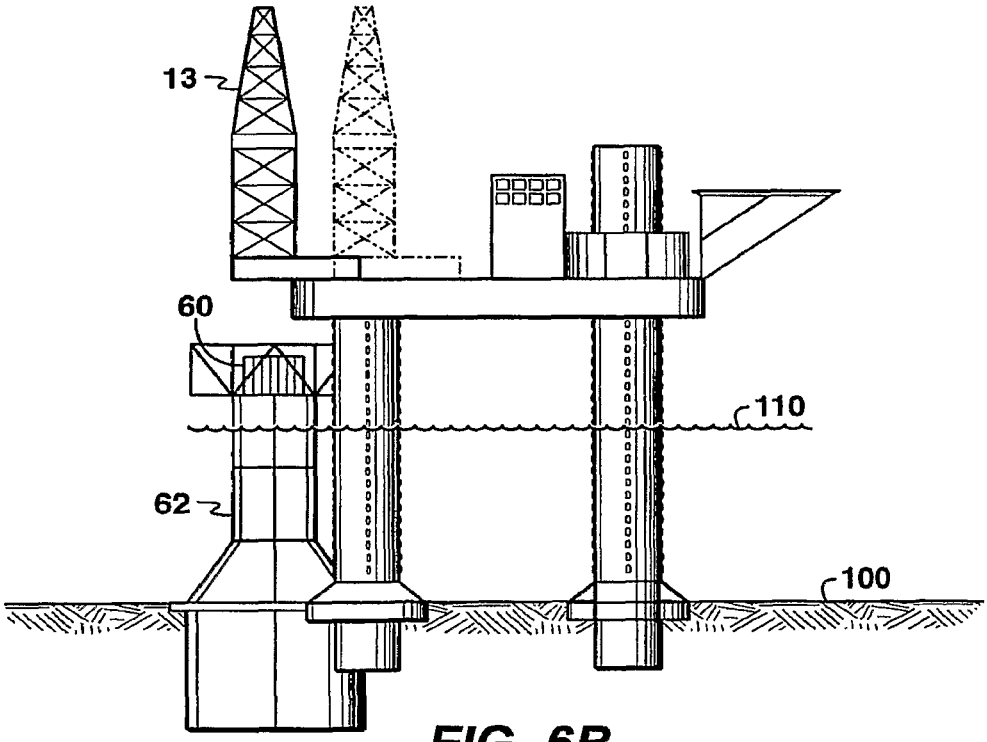
FIG. 6B is an exemplary illustration of drilling over a wellhead structure utilizing the MYADS of FIGS. 1 and 2.

In sub-arctic conditions, it is preferable that production wells have either: (1) a subsea protection structure in the case of subsea wellheads or (2) a surface-piercing structure in the case of dry trees. A "dry tree" is a wellhead that is not located under water. In this case, all of the control valves and manifolds of the surface-piercing structure are preferably located above the water 110 to provide easy access. A subsea wellhead system may be deployed on the seafloor, generally within a protective structure, such as the provided foundation 12 of the present invention. In one preferred embodiment of the present invention, the valves and manifold controls are handled remotely. The MYADS 1 of the present invention may be adapted for use with either of these two methods. FIG. 6A illustrates an alternative embodiment of a MYADS 1 used in connection with a subsea wellhead 60 enclosed in a subsea silo 61 formed by the MYADS foundation system 12, 16, i.e., part of the foundation for the drilling leg 11B. In this embodiment drilling is performed through the leg 11B. FIG. 6B shows another alternative embodiment in which MYADS 1 is used in connection with dry wellheads 60 and a surface-piercing structure 62 to protect the dry wellheads 60. Drilling rig 13 is positioned over the structure 62 on a cantilever beam or similar member and drilling is performed through the surface-piercing structure 62.

In some embodiments of the present invention, the foundation 12 system may incorporate at least one subsea wellhead silo system as illustrated in FIGS. 1 and 6A. As described above in connection with FIG. 1, this structural system can be a suction caisson, potentially augmented with an ice-protective cone 5 and scour-protecting skirt 16. Subsea wellheads are located inside the silo and above ground level. Referring to FIG. 1, the drilling leg of the MYADS may connect mechanically to the subsea silo by preferably a clamping system 6 or other system known to those skilled in the art.

In the MYADS 1, the legs are preferably about 15 meters in diameter, but in any of the embodiments disclosed herein the legs may have a diameter of about 10 meters or greater, or about 15 meters or greater, or about 20 meters or greater. The length of the legs 11 is determined by the requirements of the water depth and "air gap" (clearance between the water surface and the bottom of the hull in the elevated condition). The thicknesses of the outer and inner plates preferably range from about 25 millimeters (mm) to about 50 mm or higher. (The maximum thickness is generally limited by the availability of steel). Preferably, the diameter of the legs 11, the thickness of the inner and outer plates and other structural considerations should be chosen with the overall moment of inertia in mind. As previously stated, the moment of inertia is preferably higher than that of conventional systems and preferably in the range of about 50 meters to the fourth ($m^4$) to about 130 $m^4$.

The large diameter of the legs provides the MYADS lateral stiffness and strength to resist global ice loads, can be a detriment to the local strength of the leg. Locally, high ice loads can occur as ice impinges on the leg. As the diameter of the leg is increased, the ability to resist these local ice loads is also diminished because the local profile of the leg becomes more "flat" and less "rounded" as the leg diameter increases. Thus, depending on the leg size or diameter and the expected local ice loads, it may be desirable to strengthen the leg walls.

Leg wall strengthening in the MYADS may be accomplished by stiffening the leg wall such as is done, for example, in ship construction, and, with some modification, for hull strengthening on ice-breaking ships. In some embodiments of the present invention, leg stiffening is accomplished by adding a second wall with an intermediate material between the first wall and the second wall (i.e., a "sandwich" design). This embodiment provides localized strength by increasing the local stiffness of the wall at all locations on the leg; this option may also minimize construction costs in many cases, although that potential is site-dependent.

Figure 7A:
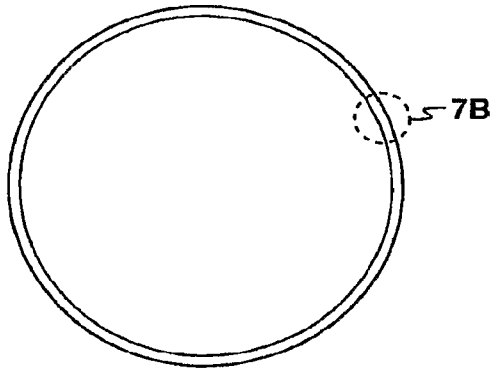
FIGS. 7A-7B are exemplary illustrations of a cross-section of a leg of the MYADS of FIGS. 1 and 2.
Figure 7B:
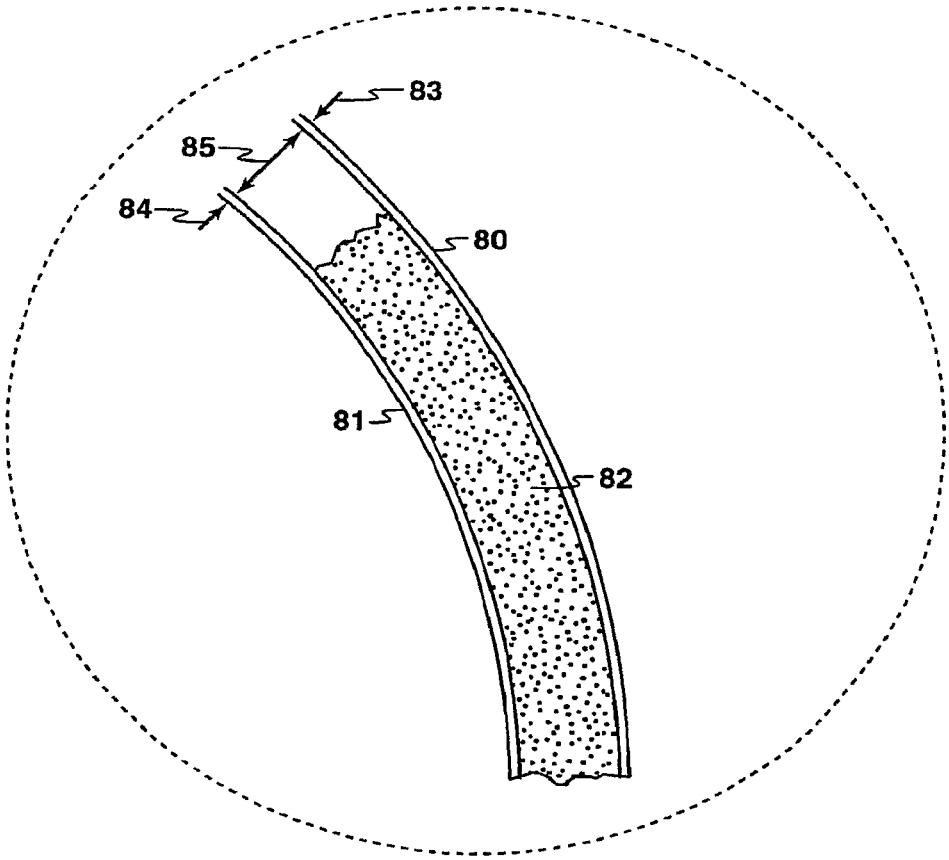

FIGS. 7A-7B show an exemplary cross-section of the legs 11 of the MYADS 1 of FIGS. 1 and 2. Accordingly, FIGS. 7A-7B may be best understood by concurrently viewing FIGS. 1 and 2. Referring to FIGS. 7A and 7B, a cross-section of a "sandwich" leg wall design is shown wherein a MYADS leg is made of an outer plate and an inner plate with bonding agent filled between the outer plate and the inner plate. FIG. 7B shows an enlarged view of one embodiment of the sandwich leg wall design that may be used in any of the embodiments of the present invention. In the embodiment shown in FIGS. 7A and 7B, the outer plate 80 has a thickness 83 of about 50 mm, the inner plate 81 has a thickness 84 of about 35 mm, and the bonding agent 82 has a thickness 85 of about 195 mm. The bonding agent 82 may be Class 300 concrete, and inner wall 81 and outer wall 80 may be made from extra high strength steel having a yield strength of about 690 megapascals (Mpa). As mentioned above, low cost concrete, grout or elastomer material may be used as the bonding agent between the walls of the sandwich design. Calculations have shown that a leg based on the exemplary structure shown in FIGS. 7A and 7B have a moment of inertia of about 113 $m^4$. As is known in the art, moment of inertia is a measure of bending stiffness.

It should be noted that although the MYADS system is disclosed with reference to a sub-arctic environment. However, the present invention may also be applied to an arctic environment or other environment having seismic activity and or floating ice or other debris that may impinge on the legs of a drilling structure. Other elements such as the shape of the legs, type of drilling operation, size of the legs, type of equipment on the platform, etc. may also be varied significantly and still be taught by the present disclosure.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the invention as defined by the following appended claims.

What is claimed is:

1. A mobile drilling system comprising:

a hull;

a wellhead;

at least two legs adapted to be lowered through the hull to contact a seabed and elevate the hull out of the water;

a foundation associated with each leg, each foundation defining a cavity, the foundation is adapted to removably attach to an end of the associated leg, the foundation is adapted to engage the seabed and secure the wellhead positioned within the cavity, wherein the at least two legs and the associated foundations are adapted for use in a sub-arctic offshore environment by resisting local and global loading due to sub-arctic ice; and a drilling rig located on the hull.

2. The mobile drilling system according to claim 1, wherein each of the at least two legs resists local and global loading due to sub-arctic ice by comprising an outer plate and an inner plate with a bonding agent filled between the outer plate and the inner plate.

3. The mobile drilling system according to claim 2, wherein the outer plate is substantially cylindrical and has a diameter of about 15 meters.

4. The mobile drilling system according to claim 3, wherein the moment of inertia of the at least two legs is between about 100 meters to the fourth ($m^4$) and about 130 $m^4$.

5. The mobile drilling system according to claim 2, wherein the thickness of the outer plate is about 50 millimeters.

6. The mobile drilling system according to claim 2, wherein the at least two legs are of substantially cylindrical shape with an inner plate diameter of about 14 meters.

7. The mobile drilling system according to claim 6, wherein the thickness of the inner plate is about 25 millimeters.

8. The mobile drilling system according to claim 2, wherein the bonding agent comprises at least one of grout and elastomeric agent.

9. The mobile drilling system according to claim 1, wherein the foundation has a diameter of about 30 meters.

10. The mobile drilling system according to claim 1, wherein at least one of the at least two legs comprise at least one of a substantially cylindrical and substantially quadrangle shape.

11. The mobile drilling system according to claim 1 further comprising a protective cone and skirt member associated with each foundation, the skirt member is adapted to engage the seabed.

12. A method of offshore drilling comprising:

providing a mobile drilling system comprising:

a hull;

a wellhead;

at least two legs adapted to be lowered through the hull to contact a seabed and elevate the hull out of a body of water;

a foundation associated with each leg, each foundation defining a cavity, the foundation is adapted to removably attach to an end of the associated leg, the foundation is adapted to engage the seabed and secure the wellhead positioned within the cavity, wherein the at least two legs and the associated foundations are adapted for use in a sub-arctic offshore environment by resisting local and global loading due to sub-arctic ice; and a drilling rig located on the hull; and drilling through at least one of the at least two legs and the foundation.

13. The method of offshore drilling according to claim 12 further comprising drilling through an ice-resistant caisson.

14. The method of offshore drilling according to claim 12, wherein each of the at least two legs are of substantially cylindrical shape and wherein each of the at least two legs resists local and global loading due to sub-arctic ice by comprising an outer plate and an inner plate with a bonding agent filled between the outer plate and the inner plate.

15. The method of offshore drilling according to claim 14, wherein the outer plate having a diameter of about 15 meters.

16. The method of offshore drilling according to claim 15, wherein the moment of inertia of the at least two legs is between about 100 $m^4$ and about 130 $m^4$.

17. The method of offshore drilling according to claim 12, wherein the thickness of the outer plate is about 50 millimeters.

18. The method of offshore drilling according to claim 12, wherein the at least two legs are of substantially cylindrical shape with an inner plate diameter of about 14 meters.

19. The method of offshore drilling according to claim 18, wherein the thickness of the inner plate is about 25 millimeters.

20. The method of offshore drilling according to claim 12, wherein the bonding agent comprises at least one of grout or elastomeric agent.

21. The method of offshore drilling according to claim 12, wherein the foundation has a diameter of about 30 meters.

22. The method of offshore drilling according to claim 12, wherein the foundation is configured to secure at least one wellhead when the system is removed from its location.

23. The method of offshore drilling according to claim 12, wherein at least one of the at least two legs are of quadrangle shape.

24. A method of producing hydrocarbons comprising:

providing a mobile drilling system comprising:

a hull;

a wellhead communicatively connected to a hydrocarbon well;

at least two legs adapted to be lowered through the hull to contact a seabed and elevate the hull out of a body of water;

at least one foundation associated with at least one of the at least two legs, each foundation defining a cavity, the foundation is adapted to removably attach to an end of the associated leg, the foundation is adapted to engage the seabed and secure the wellhead positioned within the cavity, wherein the at least one foundation and the at least two legs are adapted for use in a sub-arctic environment by resisting local and global loading due to sub-arctic ice; and a drilling rig located on the hull, wherein each of the at least two legs having a closed structure comprising an outer plate and an inner plate forming an annulus, wherein a bonding agent is disposed in the annulus;

drilling the hydrocarbon well through the leg of the drilling system comprising the foundation; and producing hydrocarbons through the hydrocarbon well.

25. The method of producing hydrocarbons according to claim 24 further comprising drilling through an ice-resistant caisson.

26. The method of producing hydrocarbons according to claim 24, wherein each of the at least two legs are of substantially cylindrical shape.

27. The method of producing hydrocarbons according to claim 26, wherein the outer plate having a diameter of about 15 meters.

28. The method of producing hydrocarbons according to claim 27, wherein the moment of inertia of the at least two legs is between about 100 meters to the fourth power ($m^4$) and about 130 $m^4$.

29. The method of producing hydrocarbons according to claim 24, wherein the thickness of the outer plate is about 50 millimeters.

30. The method of producing hydrocarbons according to claim 24, wherein the at least two legs are of substantially cylindrical shape with an inner plate diameter of about 14 meters.

31. The method of producing hydrocarbons according to claim 30, wherein the thickness of the inner plate is about 25 millimeters.

32. The method of producing hydrocarbons according to claim 24, wherein the bonding agent comprises at least one of grout or elastomeric agent.

33. The method of producing hydrocarbons according to claim 24, wherein the at least one foundation has a diameter of about 30 meters.

34. The method of producing hydrocarbons according to claim 24, wherein the foundation is configured to secure at least one wellhead when the system is removed from its location.

35. The method of producing hydrocarbons according to claim 24, wherein at least one of the at least two legs are of quadrangle shape.

36. The method of producing hydrocarbons according to claim 24, wherein the drilling takes place in a sub-arctic environment.

37. A method of installing an offshore drilling system comprising:

transporting a mobile drilling system to a location in a body of water, wherein the mobile drilling system comprises:

a hull;

a wellhead;

at least two legs adapted to be lowered through the hull to contact a seabed and elevate the hull out of the water, wherein each of the at least two legs is made of an outer plate and an inner plate with a bonding agent filled between the outer plate and the inner plate;

at least one foundation associated with at least one of the at least two legs, each foundation defining a cavity, each foundation is adapted to removably attach to an end of the associated leg, each foundation is adapted to engage the seabed and secure the wellhead positioned within the cavity, wherein the at least two legs and the associated foundations are adapted for use in a sub-arctic offshore environment by resisting local and global loading due to sub-arctic ice; and a drilling rig located on the hull;

lowering the at least two legs to a seabed;

elevating the hull above a surface of the body of water;

penetrating the at least one foundation into the seabed; and positioning the drilling rig over a drilling location.

38. The method of installing an offshore drilling system of claim 37, wherein each of the at least two legs are of substantially cylindrical shape.

39. The method of installing an offshore drilling system of claim 37, wherein the moment of inertia of the at least two legs is between about 100 $m^4$ and about 130 $m^4$.

40. The method of installing an offshore drilling system of claim 37, wherein the bonding agent comprises at least one of grout or elastomeric agent.

41. The method of installing an offshore drilling system of claim 37, wherein the installing takes place in a sub-arctic environment.

42. The method of installing an offshore drilling system of claim 37, further comprising drilling a well through at least one of the at least two legs and installing at least one wellhead within one of the at least one foundation.

43. A method of removing an offshore drilling system comprising:

providing a mobile drilling system in a first location in a body of water, wherein the mobile drilling system is installed at the first location and the mobile drilling system comprises:

a hull;

a wellhead;

at least two legs resist local and global loading due to sub-arctic ice by comprising an outer plate and an inner plate with a bonding agent filled between the outer plate and the inner plate, each of the at least two legs adapted to be lowered through the hull to contact a seabed and elevate the hull out of the water; and at least one foundation associated with at least one of the at least two legs, each foundation defining a cavity, the foundation is adapted to removably attach to an end of the associated leg, the foundation is adapted to engage the seabed and secure the wellhead positioned within the cavity;

lowering the hull into the body of water;

disengaging a leg from the foundation and raising the at least two legs, leaving the foundation engaged with the seabed and securing the wellhead; and transporting the mobile drilling system to a second location.

44. The method of removing an offshore drilling system of claim 43, wherein each of the at least two legs are of substantially cylindrical shape.

45. The method of removing an offshore drilling system of claim 44, wherein the moment of inertia of the at least two legs is between about 100 meters to the fourth power ($m^4$) and about 130 $m^4$.

46. The method of removing an offshore drilling system of claim 43, wherein the bonding agent comprises at least one of grout or elastomeric agent.

47. A method of re-installing an offshore drilling system comprising:

providing a mobile drilling system on a body of water, wherein the mobile drilling system comprises:

a hull;

a wellhead;

at least two legs;

at least one foundation associated with at least one of the at least two legs, the foundation defining a cavity, the foundation is adapted to removably attach to an end of the associated leg, the foundation is adapted to engage the seabed and secure the wellhead positioned within the cavity, the at least one foundation and associated leg resisting local and global loading due to sub-arctic ice; and a drilling rig located on the hull, wherein each of the at least two legs resists local and global loading due to sub-arctic ice by comprising an outer plate and an inner plate with a bonding agent filled between the outer plate and the inner plate;

transporting the mobile drilling system to a drilling location, wherein the drilling location includes a first foundation;

lowering the at least two legs to a seabed, wherein one of the at least two legs is lowered into the first foundation;

elevating the hull above a surface of the body of water;

penetrating the foundation of the remaining legs of the at least two legs into a seabed; and positioning the drilling rig over a drilling location.

48. The method of re-installing an offshore drilling system of claim 47, wherein each of the at least two legs are of substantially cylindrical shape.

49. The method of re-installing an offshore drilling system of claim 48, wherein the moment of inertia of the at least two legs is between about 100 meters to the fourth power ($m^4$) and about 130 $m^4$.

50. The method of re-installing an offshore drilling system of claim 47, wherein the bonding agent comprises at least one of grout or elastomeric agent.

51. The method of re-installing an offshore drilling system of claim 47, further comprising locating the one of the at least two legs into the first foundation utilizing a guide system.

52. The method of re-installing an offshore drilling system of claim 47, wherein the first foundation provides well protection to at least one subsea wellhead.

* * * * *